United States Patent [19]

Heinrich

[11] Patent Number: 5,042,663

[45] Date of Patent: Aug. 27, 1991

[54] JOINABLE INFLATABLE BLADDERS FOR PACKAGING

[76] Inventor: Richard Heinrich, 1192 Ray Drive, Kelowna, B.C., Canada, V1X 6R5

[21] Appl. No.: 470,264

[22] Filed: Jan. 25, 1990

Related U.S. Application Data

[63] Continuation-in-part of Ser. No. 347,678, May 5, 1989, abandoned.

[51] Int. Cl.[5] ..... B65D 81/02; B61D 45/00

[52] U.S. Cl. ..... 206/522; 206/820; 383/3; 383/37; 410/119

[58] Field of Search ..... 206/522, 521, 820; 383/3, 37; 410/119, 125

[56] References Cited

U.S. PATENT DOCUMENTS

| | | | |
|---|---|---|---|
| 1,510,260 | 9/1924 | Cyrenius | 206/820 X |
| 2,462,215 | 2/1949 | Norman et al. | 383/3 X |
| 2,715,231 | 8/1955 | Marston | 206/522 X |
| 3,199,689 | 8/1965 | Feldkamp | 206/522 X |
| 3,226,285 | 12/1965 | Lovenko | 206/522 X |
| 3,389,534 | 6/1968 | Pendleton | 206/522 X |
| 3,667,593 | 6/1972 | Pendleton | 206/522 X |
| 3,673,968 | 7/1972 | Bertram | 206/522 X |
| 4,164,970 | 8/1979 | Jordan | 206/522 X |
| 4,223,043 | 9/1980 | Johnson | 206/820 X |
| 4,360,969 | 11/1982 | Collier | 206/820 X |

FOREIGN PATENT DOCUMENTS

| | | | |
|---|---|---|---|
| 0096364 | 12/1983 | European Pat. Off. | 206/522 |
| 0098347 | 1/1984 | European Pat. Off. | 206/522 |
| 1000728 | 10/1951 | France | 206/522 |
| 1157061 | 12/1957 | France | 206/522 |
| 2389547 | 1/1979 | France | 206/522 |
| 958500 | 5/1964 | United Kingdom | 206/522 |

*Primary Examiner*—Bryon P. Gehman
*Attorney, Agent, or Firm*—Smart & Biggar

[57] ABSTRACT an inflatable packaging material comprises a plurality of flexible bladders formed of tubes sealed at one end and partially sealed at the other end to provide a passageway which may be closed by a stopper. In one embodiment, a protuberance extends from the sealed end of each bladder which may releasably engage the walls of a passageway of an adjacent bladder to join the bladders end-to-end. In a second embodiment, the sealed end includes an eyelet and the passageway end includes a stopper attached to such end by a flexible trunk such that the stopper of one bladder may releasably engage the eyelet of an adjacent bladder to join the bladders end-to-end. The bladders may line a carton to protect an article shipped therein.

8 Claims, 6 Drawing Sheets

JOINABLE INFLATABLE BLADDERS FOR PACKAGING

Figure 1:
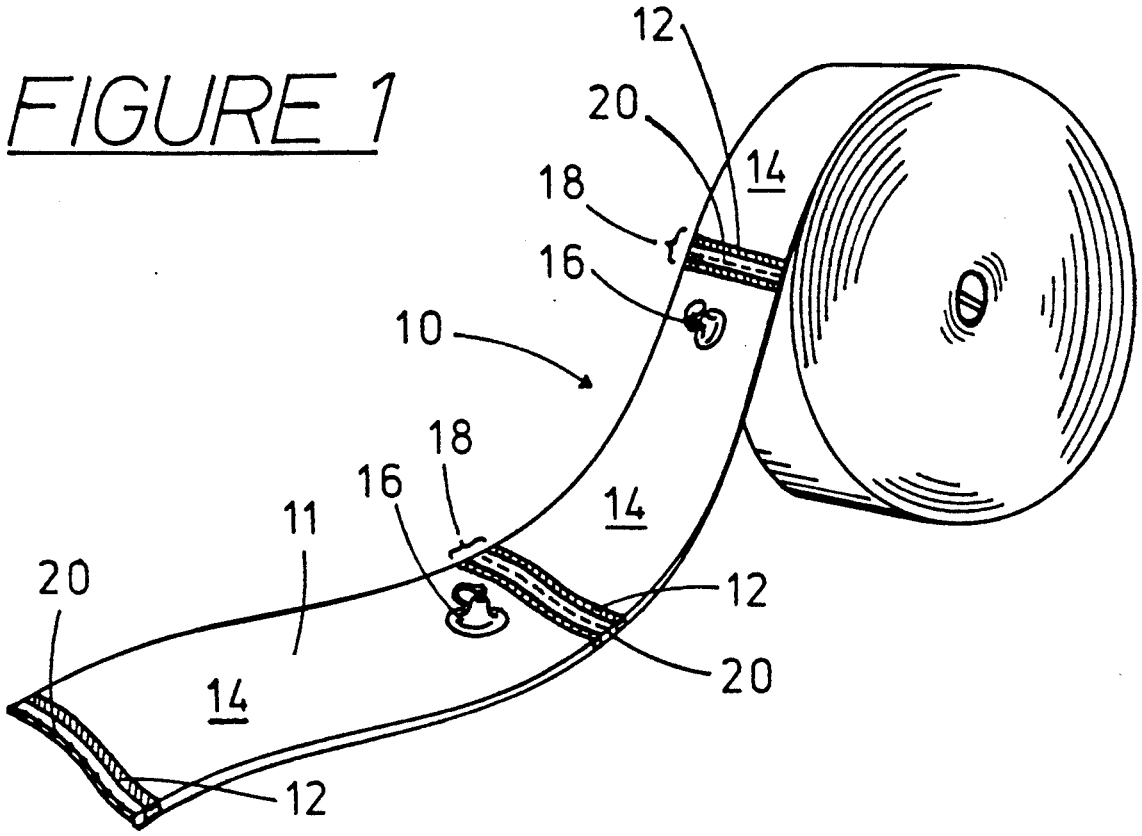

This application is a continuation-in-part application of U.S. patent application Ser. No. 347,678 filed May 5, 1989.

This invention relates to an inflatable packaging material and method for its use.

Formed styrofoam and styrofoam chips are in widespread use as packaging materials. These materials are disposable which, consequently, further burdens waste disposal facilities and gives rise to environmental concerns. Further, styrofoam contains CFC's so that its manufacture may deleteriously affect the earth's ozone layer.

Various types of inflatable packaging are known, some of which are reusable. For example, U.S. Pat. No. 4,569,082 to Ainsworth discloses an inflatable bladder sized to line the interior of a particular carrying case. A pocket element is received in the interior of the bag for receiving articles to be transported. After filling the pockets, the carrying case may be closed and the bladder inflated to protect the articles therein. Being an item of luggage, the carrying case, and the inflatable bladder, are reusable. Ainsworth's apparatus has the disadvantage, however, that the air bladder is particular to a particular carrying case so that it would not be usable with a carrying case of different dimensions. Further, Ainsworth's apparatus would be ill-suited to the transportation of heavy articles as the air bladder does not have side walls to stabilise and protect the articles.

An arrangement which could overcome the latter problem of Ainsworth's device is disclosed in U.S. Pat. No. 3,889,743 to Presnick. Presnick discloses an inflatable liner for a packing box. The liner comprises a number of bi-walled thermoplastic panels each joined to at least one neighbouring panel at an articulation. The panels, so joined, form a blank which, when folded at the articulations, may take the shape of the packing box. An air passage is provided between joined panels and one panel incorporates an air valve.

After forming a packing box, Ainsworth's liner blank may be folded into the same box-shape and placed into the packing box so that the panel with the air valve is at the lid of the packing box. Thereafter, air may be introduced into the liner by way of the valve and material packed in the lined box. While this arrangement could overcome the problem of dealing with heavier articles, Presnick's only disclosed purpose for the liner is as insulation. In any event, Presnick's liner also has the disadvantage that it is particular to one size and shape of packing box so that a different sized liner would need to be constructed for each new type of packing box. Presnick's liner has the further disadvantage that should several items be packed in the box, the liner would not shield the items from each other.

Accordingly, there remains a need for an inflatable packaging material which overcomes disadvantages present with known inflatable packaging means.

According to this invention, there is provided an inflatable packaging material comprising a plurality of joinable flexible bladders, each bladder of said plurality of flexible bladders having: a protuberance protruding from a wall of the bladder; a passageway through a wall of the bladder communicating the inside of the bladder with the outside environment through which said bladder may be inflated or deflated, said passageway configured so as to be releasably joinable with said protuberance; whereby a protuberance of one of said plurality of bladders may be releasably engaged in a passageway of another of said plurality of bladders thereby permitting the joining of said plurality of bladders.

In another aspect there is provided an inflatable packaging material comprising a plurality of flexible bladders, each bladder of said plurality of flexible bladders having: an eyelet supported by a wall of the bladder; a passageway through a wall of the bladder communicating the inside of the bladder with the outside environment through which said bladder may be inflated or deflated; passageway stopper means attached by a flexible trunk to a wall of the bladder proximate said passageway, said stopper means for stoppering said passageway and said stopper means configured so as to be releasably engageable with said eyelet; whereby one of said plurality of bladders may be joined with another of said plurality of bladders by engaging the passageway stopper means of said one of said plurality of bladders with the eyelet of said another of said plurality of bladders.

Figure 2:
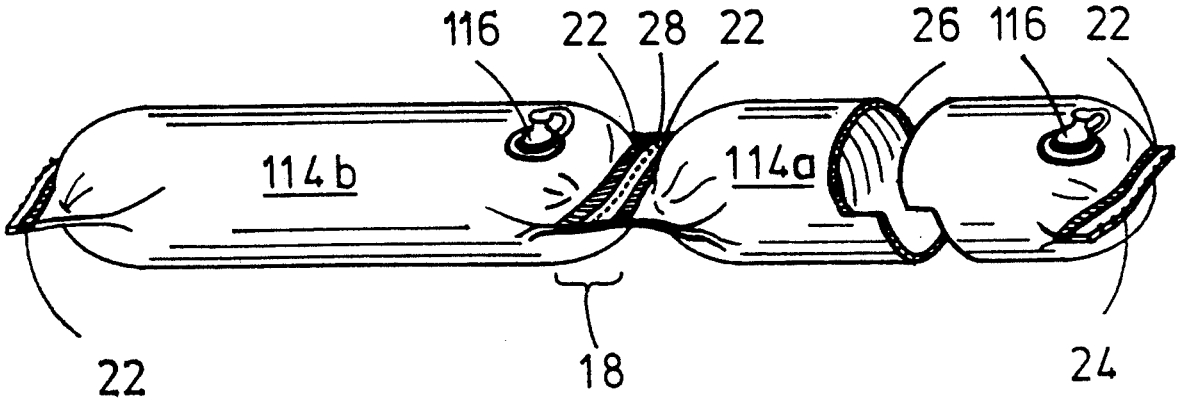
Figure 3:
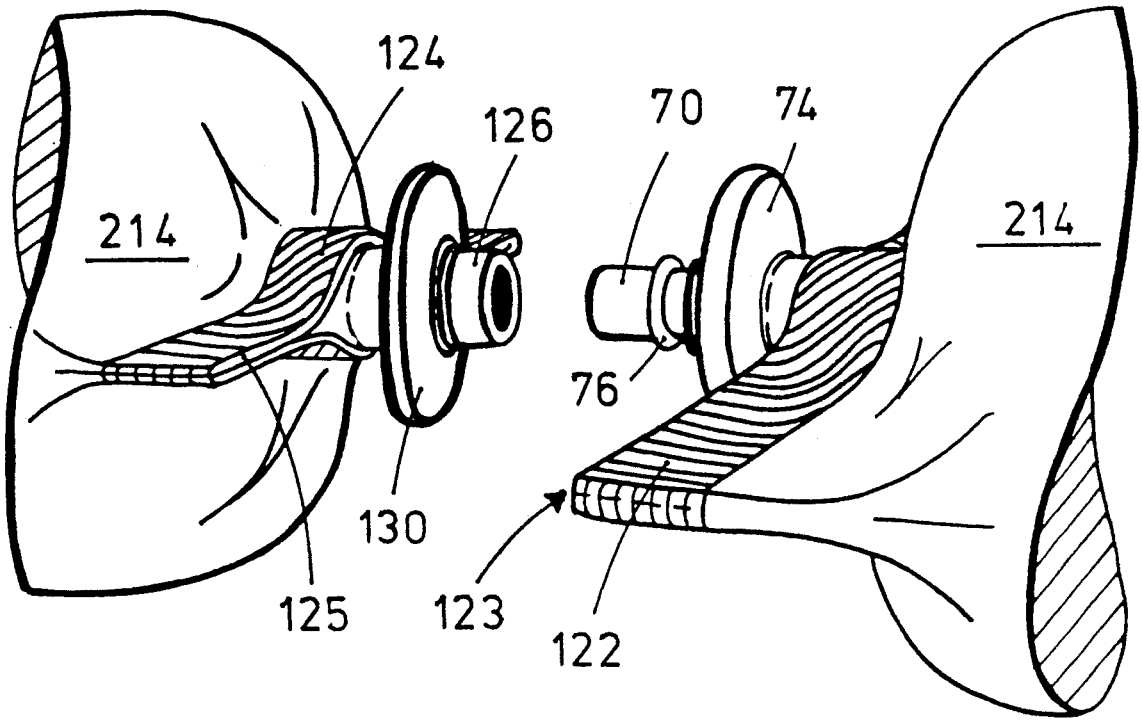
Figure 4:
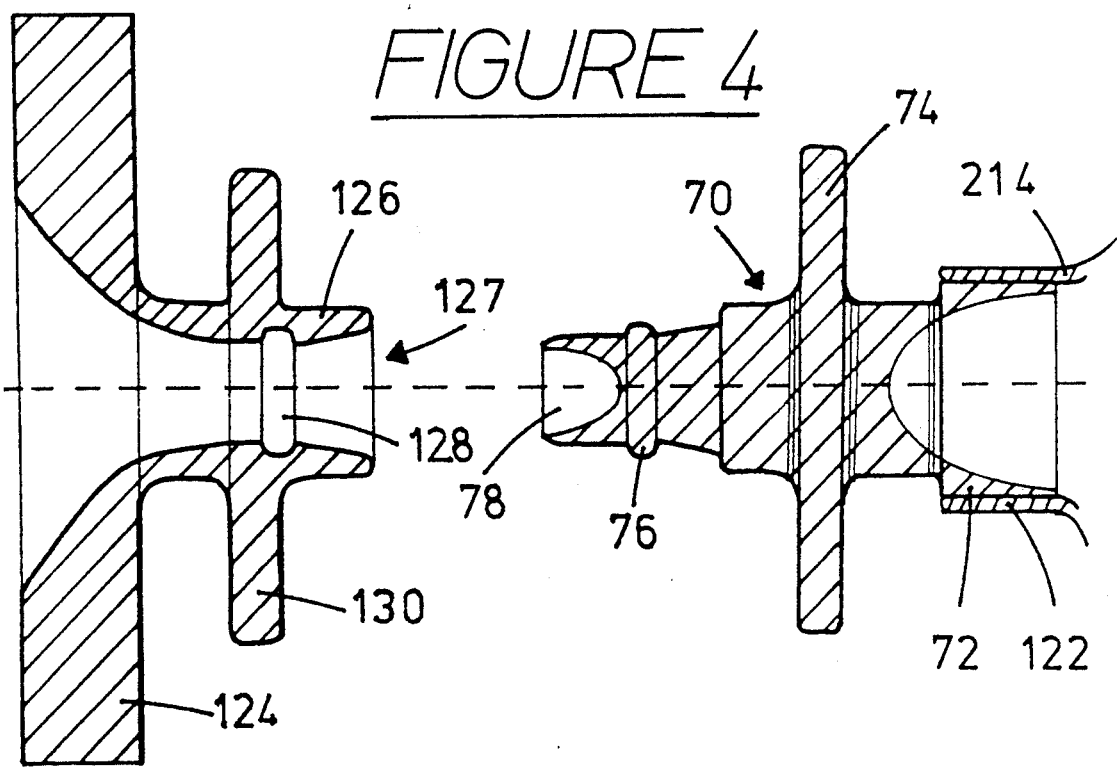
Figure 5:
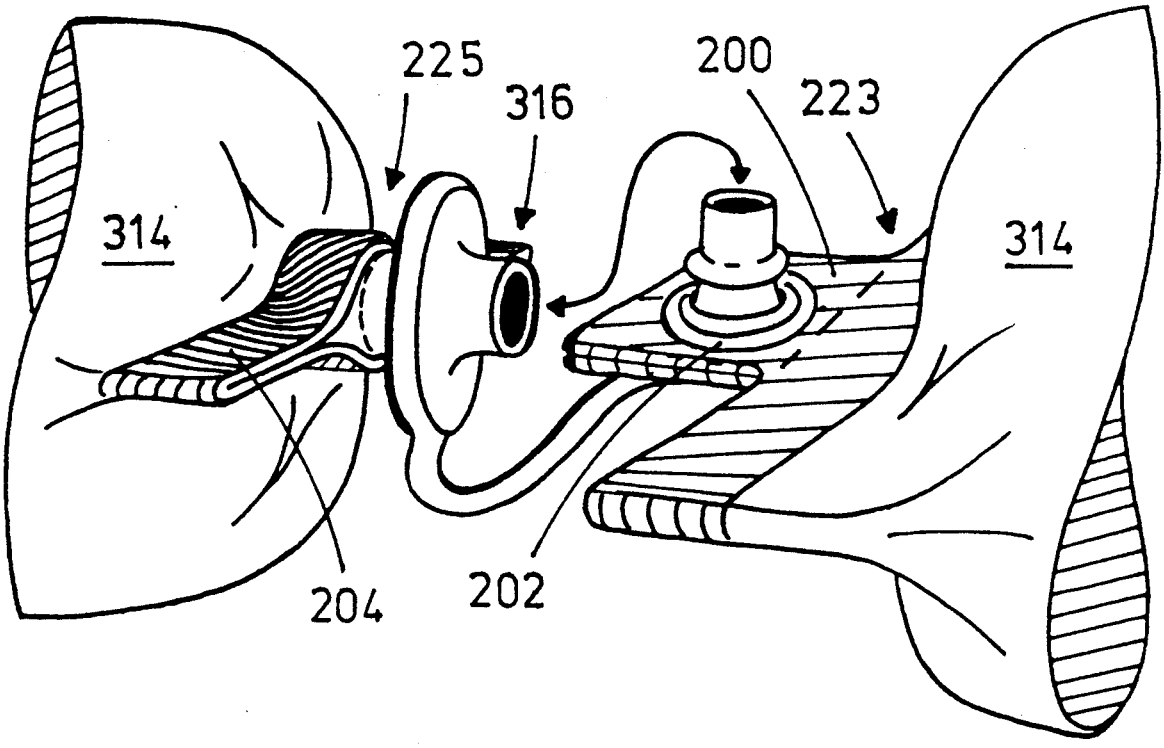
Figure 6:
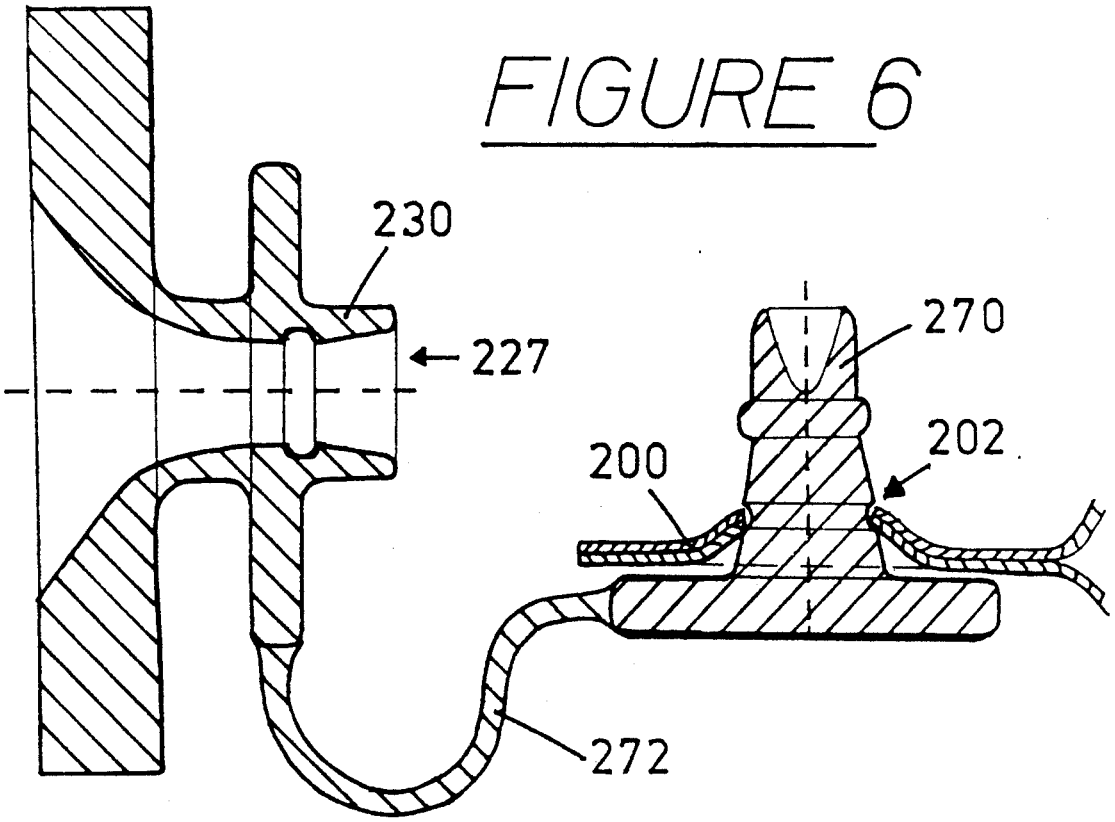
Figure 7A:
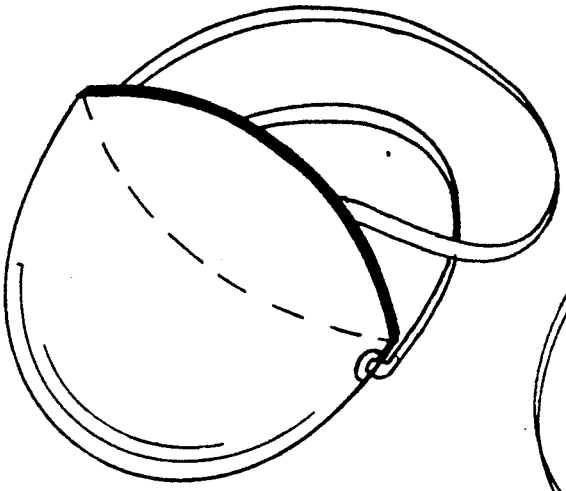
Figure 7B:
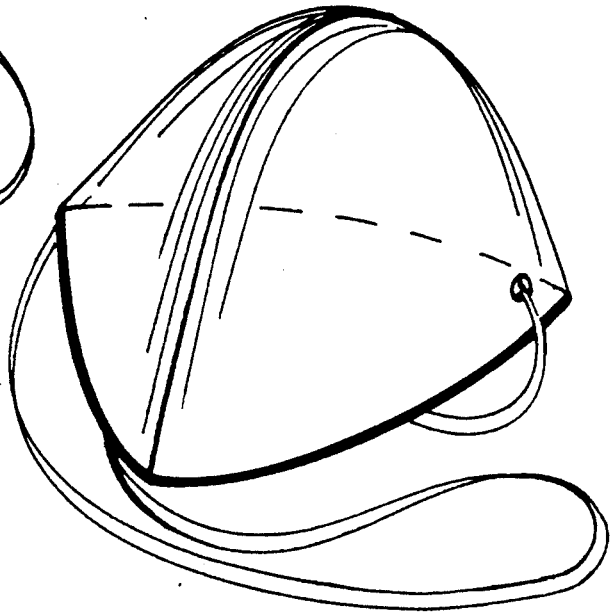
Figure 7C:
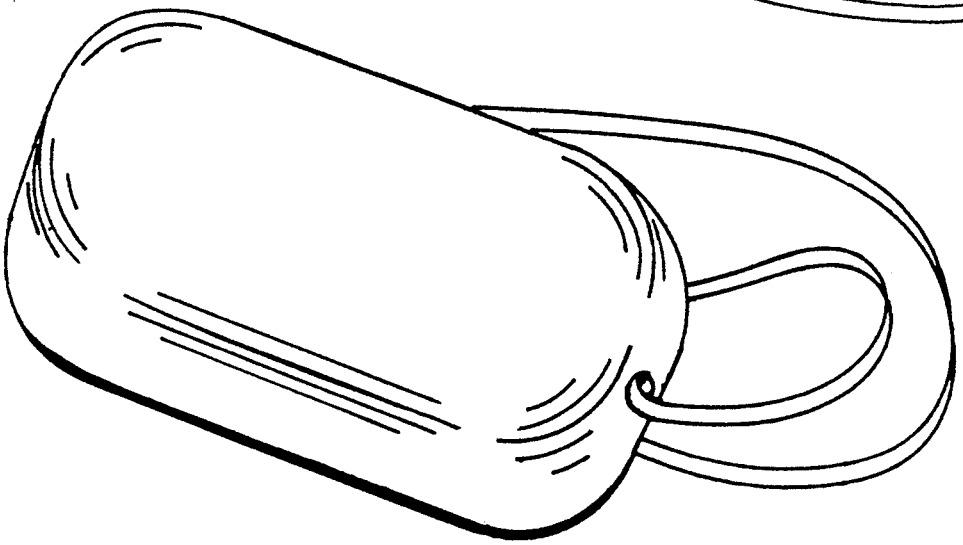
Figure 7D:
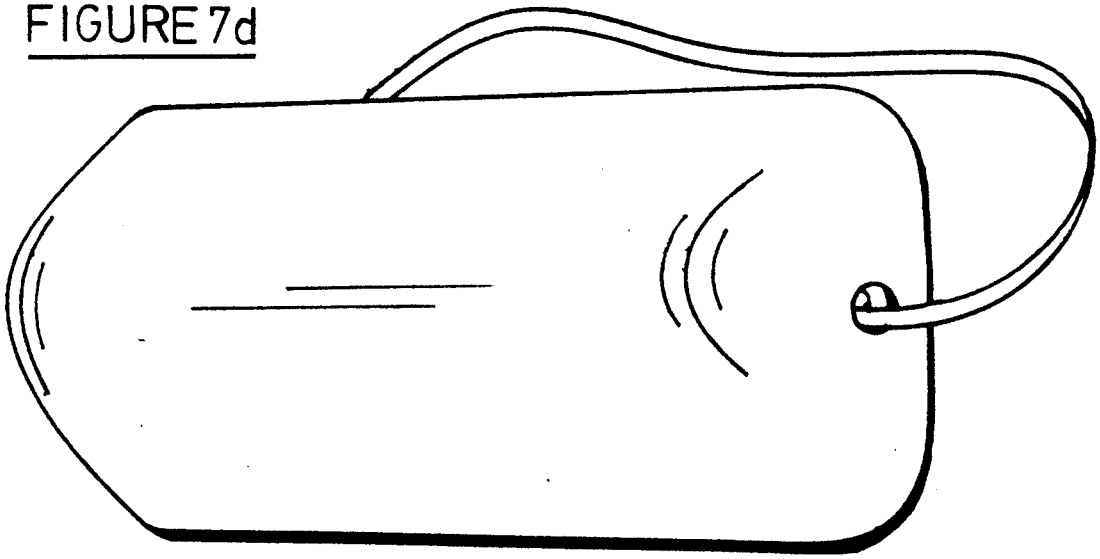
Figure 8A:
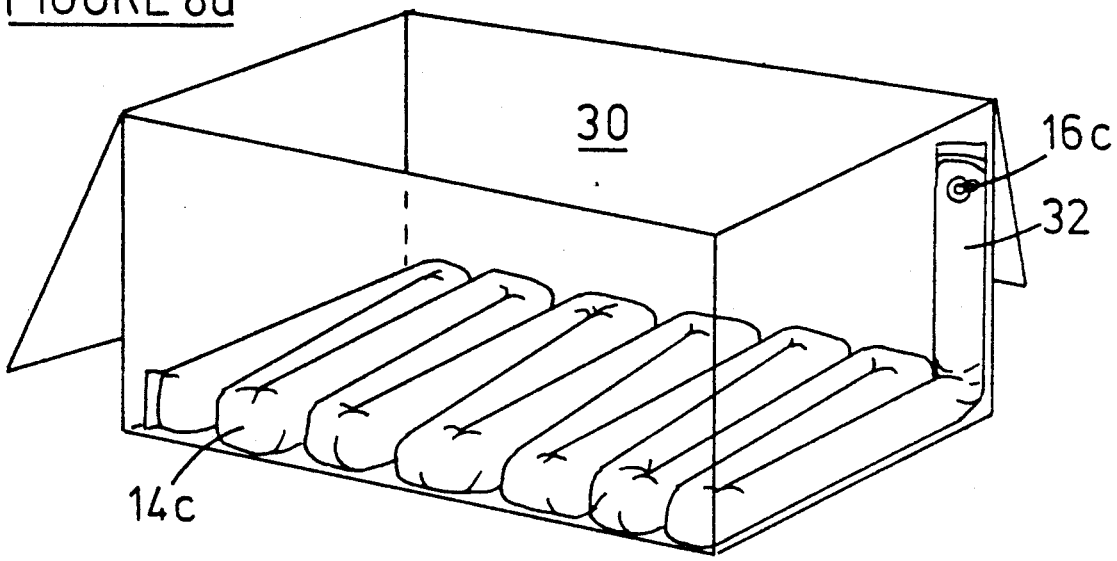
Figure 8B:
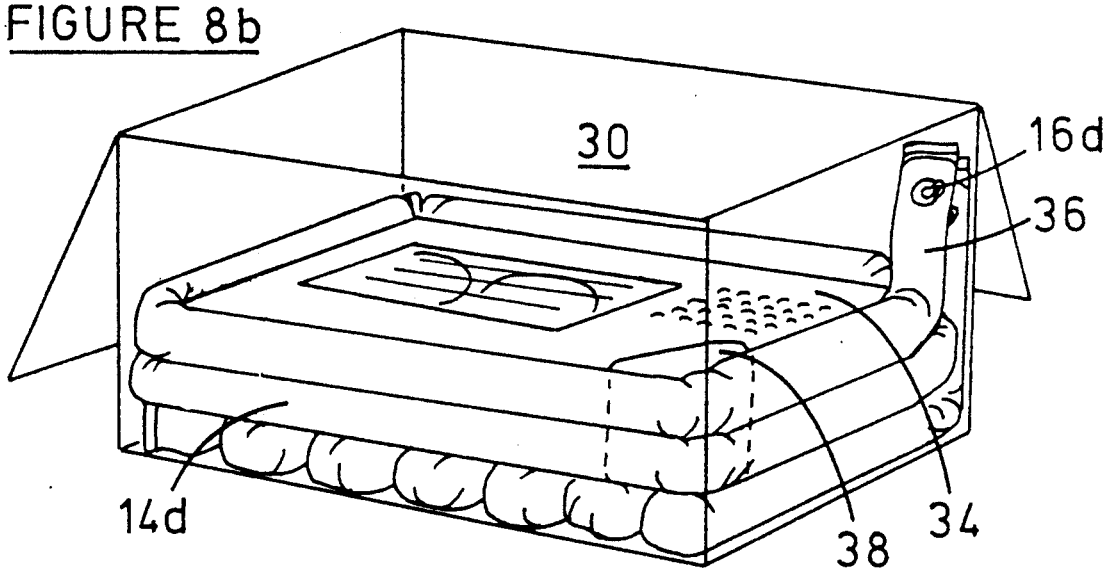
Figure 8C:
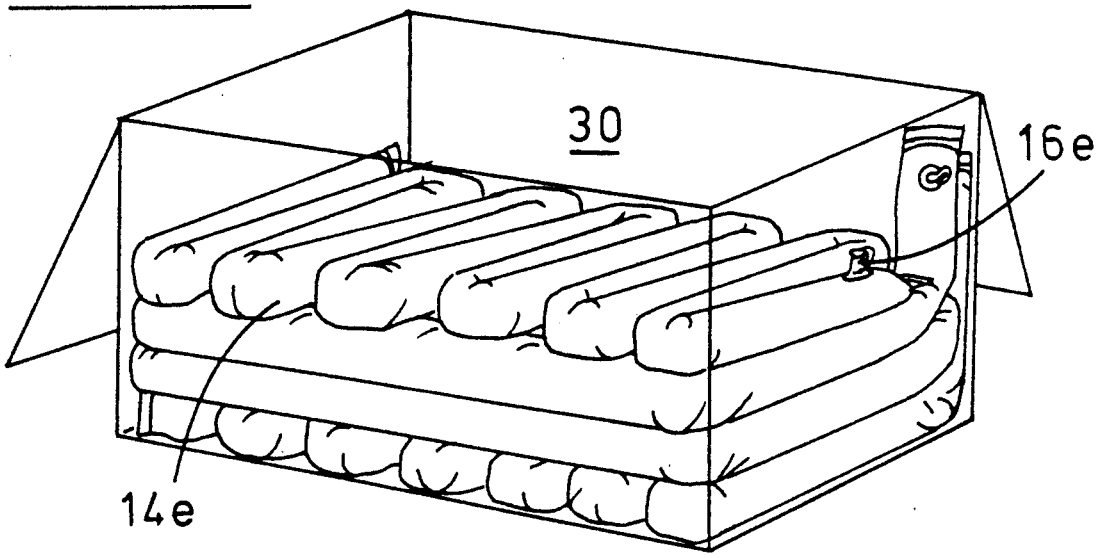
Figure 9:
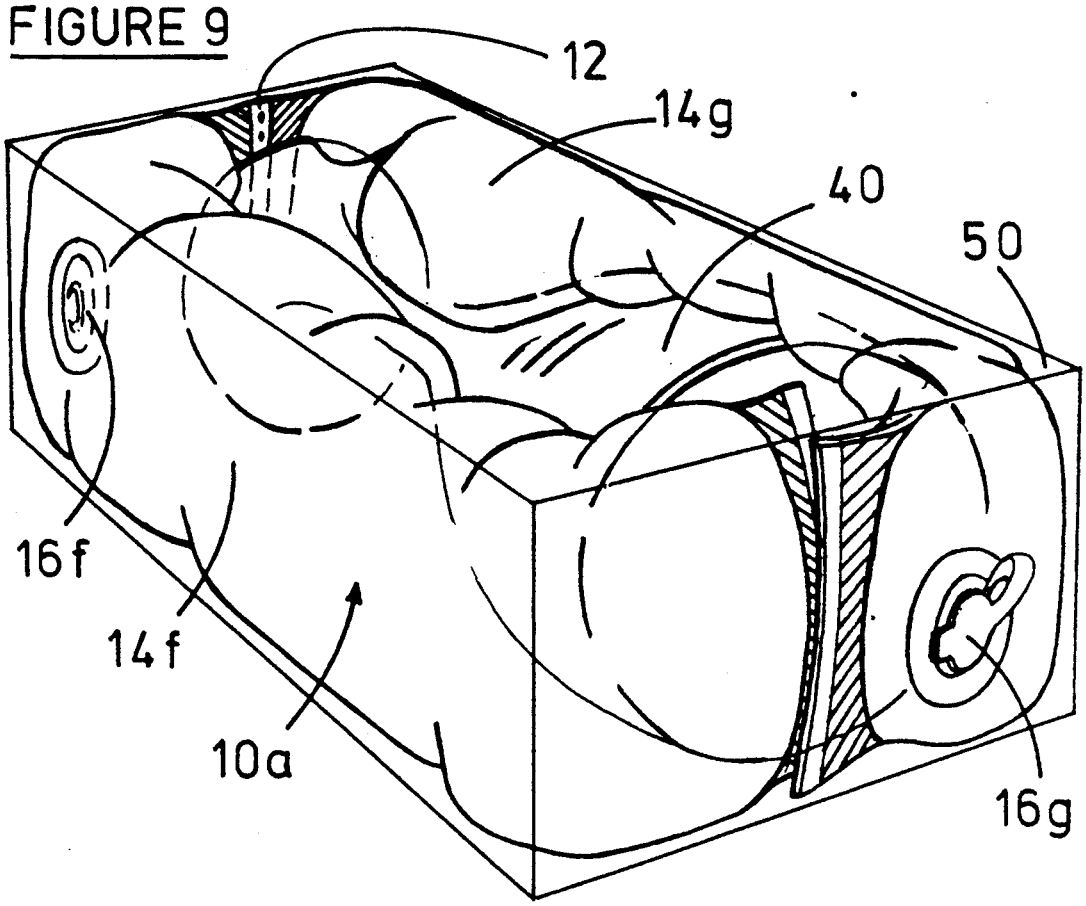
Figure 10:
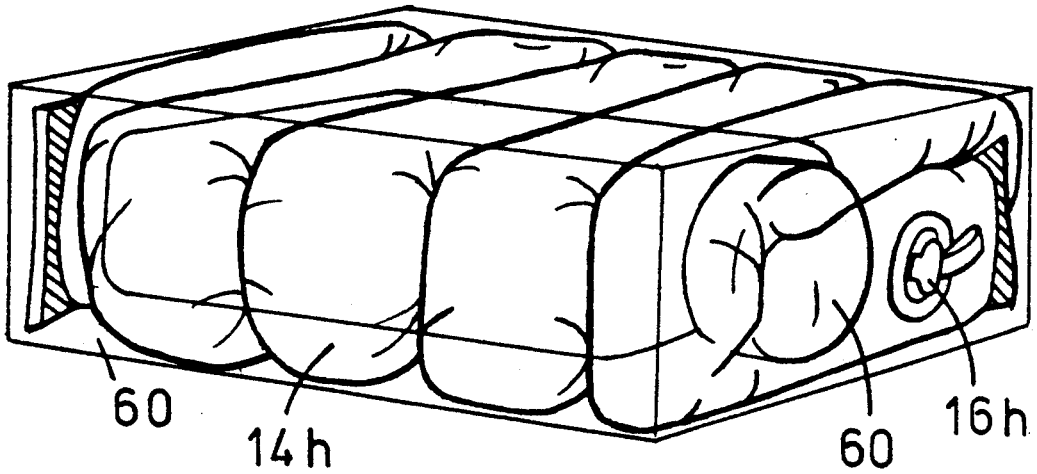

In the figures which illustrate preferred embodiments of the invention:

FIG. 1 comprises a perspective view of one embodiment of this invention,

FIG. 2 comprises a perspective view of another embodiment of this invention, FIG. 3 is a perspective view of a third embodiment of this invention, FIG. 4 is a sectioned side view of the embodiment of the invention illustrated in FIG. 3, FIG. 5 is a perspective view of a further embodiment of this invention, FIG. 6 is a sectioned side view of the embodiment of the invention illustrated in FIG. 5, FIGS. 7*a* through 7*d* comprise perspective views of shields which may be used in connection with the packaging material of this invention, FIGS. 8*a* through 8*c* illustrate a method of use of the packaging material of this invention, FIG. 9 illustrates a further method of use of the packaging material of this invention, and FIG. 10 illustrates a further method of use of the packaging material of this invention.

The packaging material of FIG. 1, illustrated generally at 10, comprises a flexible tube 11 sealed at both ends and at zones 18 along its length to form a plurality of bladders 14 flexibly joined end-to-end—with zones 18 comprising the joints 12 between adjacent air-bladders. An air valve 16 communicates with the interior of each air-bladder. The air valve 16 is proximate one end of each air-bladder.

Zones 18 are constructed so that adjacent air-bladders may be separated without being punctured. This may be accomplished in any of the following ways. Firstly, the seal at zone 18 may extend across the width of the zone so that the seal is of sufficient width that adjacent air-bladders may be separated without being punctured by cutting across the zone 18 between the air-bladders. Alternatively (as illustrated in FIG. 2), each zone 18 may comprise two adjacent seals separated by an area which may be cut to separate two adjacent air-bladders without puncturing the bladders. In either case, zone 18 may have a perforation running therealong (illustrated in FIG. 1 at 20) which allows adjacent air-bladders to be separated by pulling same apart at the perforation. In consequence of this construction, a selected length of packaging material comprising a number of air-bladders joined end-to-end may be separated from a longer length of the packaging material.

In the embodiment of the invention illustrated in FIG. 2, two air-bladders 114*a*, 114*b* are joined end-to-end and in an inflated condition with their valves 116 closed. In the FIG. 2 embodiment, each end of both air-bladders is sealed with a heat weld seal 22 so that the zone 18 between the air-bladders comprises two heat weld seals 22 as well as a secondary zone 28 between the two heat weld seals. As hereinbefore described, this allows the adjacent air-bladders to be separated by cutting through secondary zone 28. The free end of air-bladder 114*a* shows this cut at 24.

For reasons which will become more apparent hereinafter, zones 18 may either be formed at regular intervals along the length of the packaging material so as to form air-bladders of uniform length or the air-bladders of a length of packaging may form a repeating series of different lengths.

FIGS. 3 and 4 illustrate another embodiment of the invention wherein heat seal 122 seals one end 123 of each air-bladder 214 and holds the supporting end 72 of a protuberance 70 in order to mount the protuberance to the air-bladder. Protuberance 70 comprises a graspable portion 74 to assist in its manipulation. A radially enlarged annular ridge 76 is provided on the protuberance. The protuberance 70 may be formed of a resilient material with the free end of protuberance 70 containing a blind generally conical hole 78 which facilitates the compression of the free end of the protuberance. Heat seal 124 partially seals end 125 of each air-bladder 214 by sealing pipe 126 in end 125 of each air-bladder 214 thereby providing an air passageway 127 in the end of the air-bladder through pipe 126. Pipe 126 has a flexible wall and an annular depression 128 in the wall. Radially enlarged portion 130 of pipe 126 facilitates manipulation of the pipe.

The protuberance 70 of end 123 of one air-bladder 14 acts as a stopper for the air passageway 127 of end 124 of an adjacent air-bladder and also acts to engage the two air-bladders end-to-end. More particularly, protuberance 70 and air passageway 127 may be sized for an interference fit and the protuberance made of a stiffer material than pipe 127 so that the wall of the pipe compresses as the protuberance is inserted. When annular ridge 76 reaches the annular depression in the pipe, the annular ridge snaps into the depression to engage and hold the protuberance within the air passageway. Portion 130 of the pipe and portion 74 of the protuberance facilitate disengagement of the annular ridge 76 from the annular depression and removal of the protuberance from the air passageway.

Because of these releasable engagement means between adjacent air-bladders, a plurality of air-bladders may be releasably joined end-to-end. The last air-bladder in a chain may be stoppered with a stopper similar in configuration to protuberance 70 but not associated with an air-bladder.

In use, when a packing crate is unloaded, the air-bladders therein may be separated and deflated then rejoined end-to-end with other air-bladders of the same type and rolled up to form rolls of air-bladders for shipment back to the shipper for reuse. Thus, this feature of releasably engageable air-bladders greatly facilitates the shipping of these air-bladders.

In the embodiments of FIGS. 5 and 6, end 223 of each air-bladder 314 is heat welded to provide a tab 200; an eyelet 202 is mounted in this tab. A valve 316 is mounted in the tab 204 formed by the heat seal in the opposite end 225 of each air-bladder 314. Valve 316 comprises a pipe 230 with air passageway 227 into the bladder and a stopper 270 attached by trunk 272 to the side of the pipe 230.

Stopper 270 has a truncated conical shape and is made of a resilient material. The stopper is sized so as to be able to stopper air passageway 227. As well, the conical shape of the stopper allows it to be jammed into eyelet 202 of an adjacent air-bladder in order to releasably link adjacent air-bladders end-to-end. Thus, the stopper 270 with its trunk 272 joining to one end of an air-bladder comprises an engageable means as does the eyelet 202 in the other end of the air-bladder.

As explained in connection with the embodiment of FIGS. 3 and 4, this feature of releasably engageable air-bladders greatly facilitates the shipping of these air-bladders since deflated air-bladders may be joined end-to-end and formed into rolls for shipment.

With a roll of air-bladders made in accordance with the embodiments of this invention described in FIGS. 3, 4 and FIGS. 5, 6, desired lengths of packaging material may be separated from the roll by manipulation of the aforedescribed engagement means.

The air-bladders are constructed of a flexible and durable material such as vinyl or rubber. The thickness of the wall of the air-bladders may be selected depending upon the application (heavier articles to be packed require thicker walled air-bladders). The length and diameter of the air-bladders may also be selected when constructing the packaging material depending upon the application.

FIGS. 7*a* through 7*d* are perspective views of an assortment of protective shields which may be strapped around corners or other protrusions of an object to be packed. The shields are constructed of an unbreakable stiff material, such as nylon, with rounded outside edges. The purpose of these shields is to protect the air-bladders of the subject packaging material from puncture.

FIGS. 8*a* through 8*c* illustrate one method of use of the packaging material of this invention—in FIG. 8 the embodiment of the air-bladders illustrated in FIG. 1 are employed, however, it will readily be apparent that any of the air-bladder embodiments hereinbefore described may be used. A long air-bladder 14*c*, after separation from a length of packaging material, is inflated. Inflation may be by mouth, pump or compressed air -heavier articles generally require a higher air pressure. After inflation valve 16*c* is closed. The inflated air-bladder may then line the bottom of a packing carton 30 by flexing the air-bladder into a zig-zag pattern along the bottom of the carton, as illustrated in FIG. 8*a*. Preferably the length of the air-bladder is chosen so that after it lines the bottom of the carton an upstanding portion 32 containing valve 16*c* remains which runs along one corner of the carton and terminates at the open top of the carton.

As shown in FIG. 8*b*, an article to be packed 34 may then be placed in the packing carton atop the zig-zag portion of air-bladder 14*c* with a second air-bladder 14*d* surrounding the sides of the article. FIG. 8*b* shows a shield 38 employed to shield the air-bladder 14*d* from a corner on the article. Air-bladder 14*d* preferably has an upstanding portion 36 terminating at the open top of the carton so that its valve 16*d* is also readily accessible when the carton is opened.

A final air-bladder 14*e* may then be folded into a zig-zag shape atop the article 34, as illustrated in FIG. 8*c*. Carton 30 is then ready to have a second article packed atop air-bladder 14*e*. After carton 30 is filled it may be closed and sealed and it will be clear that the articles therein, including article 34, are then shielded from shocks on all sides and are stabilised in the carton by the inflated packaging material of this invention.

In FIG. 8, three single air-bladders were employed in connection with article 34 so that valves 16*c*, 16*d*, 16*e* of the air-bladders would be more readily accessible. Alternatively, the length of the air-bladders could have been chosen so that there was at least one air-bladder between each fold in the air-bladders 16*c*, 16*d*, and 16*e*. This latter approach is preferred where there is a possibility of any of the air-bladders being punctured during transit so that the deflation of an air-bladder will not appreciably affect the shielding and stabilising properties of the packaging material.

It will be realised that for optimal packing of packing carton 30, air-bladders 14*c*, 14*d*, and 14*e* are of different lengths. If packing carton 30 contains a number of articles, a number of air-bladders identical with air-bladders 14*d* and 14*e* are preferred whereas only one air-bladder of length 14*c* is needed to line the bottom of the packing carton. Consequently, for the application of packing articles as illustrated in FIG. 8*b* in packing cartons having the dimensions of carton 30, the length of packaging material utilised preferably has a repeating series of lengths of air-bladders comprising one bladder of length 14*c* followed by as many pairs of bladders of length 14*d* and 14*e* as there are articles to be packed in a single carton.

FIG. 9 illustrates a second method of use of the packaging material of this invention (again illustrated using the embodiment of the air-bladders shown in FIG. 1). A length of partially inflated packaging material 10*a* comprising two air-bladders 14*f* and 14*g* joined at joint 12 are enfolded around a frangible article 40. The packaging material with enfolded article is then inserted in a packing carton 50 so that the valves of the air-bladders 16*f* and 16*g* are at either end of the carton. The partial inflation of the air-bladders facilitates insertion. Additional air may then be added to each air-bladder by accessing either end of the carton. The carton may then be sealed.

FIG. 10 illustrates a third application of the packaging material of the invention. A single partially inflated air-bladder 14*h* is coiled around an article 60. The article with air-bladder is then inserted into a packing carton 62 with the valve 16*h* of the air-bladder at the open end of the box. The air pressure in the air-bladder may then be adjusted as required and the box closed.

After a packing carton reaches its destination and is opened, the air-bladders may be deflated to assist in the unpacking. The air-bladders, unless punctured during transit, may then be reused. In this regard, the lengths of packaging material used in a carton may be rerolled after deflation and returned to the packager. As beforenoted, the embodiments of the air-bladders illustrated in FIGS. 3, 4 and FIGS. 5, 6 are particularly suited for rerolling because of their ability to be linked after deflation.

By providing a packing carton which is intentionally oversized and a second layer of air-bladders, the subject packaging material will provide thermal insulation.

The subject packaging material may also find application in the packaging of articles for transit which are not in a packing carton. For example, inflated zig-zag lengths of the subject packaging material may be placed between windows loaded on a truck.

I claim:

1. An inflatable packaging material comprising a plurality of joinable flexible bladders, each bladder of said plurality of flexible bladders having:

(a) a protuberance protruding from a wall of the bladder;

(b) a passageway through a wall of the bladder communicating the inside of the bladder with the outside environment through which said bladder may be inflated or deflated, said passageway configured so as to be releasably joinable with said protuberance;

whereby a protuberance of one of said plurality of bladders may be releasably engaged in a passageway of another of said plurality of bladders thereby permitting the joining of said plurality of bladders.

2. The inflatable packaging material of claim 1 wherein each of said plurality of flexible bladders comprises a flexible tube having a sealed first end incorporating said protuberance and a partially sealed second end to provide said passageway in said second end;

whereby a protuberance of one of said plurality of bladders may be releasably engaged in a passageway of another of said plurality of bladders thereby permitting end-to-end joining of said plurality of bladders.

3. The inflatable packaging material of claim 2 wherein said protuberance is generally cylindrical, is sized for an interference fit with said passageway, and has a radially projecting ridge and wherein said passageway has flexible walls and has a radially directed depression sized for engagement with said radially projecting ridge whereby, when such a protuberance is inserted in said passageway, said radially projecting ridge deflects the walls of said passageway and may snap into said radially directed depression.

4. The inflatable packaging material of claim 1 wherein said plurality of bladders are constructed by vinyl or rubber.

5. An inflatable packaging material comprising a plurality of flexible bladders, each bladder of said plurality of flexible bladders having:

(a) an eyelet supported by a wall of the bladder;

(b) a passageway through a wall of the bladder communicating the inside of the bladder with the outside environment through which said bladder may be inflated or deflated;

(c) passageway stopper means attached by a flexible trunk to a wall of the bladder proximate said passageway, said stopper means for stoppering said passageway and said stopper means configured so as to be releasably engageable with said eyelet;

whereby one of said plurality of bladders may be joined with another of said plurality of bladders by engaging the passageway stopper means of said one of said plurality of bladders with the eyelet of said another of said plurality of bladders.

6. The inflatable packaging material of claim 5 wherein each of said plurality of flexible bladders comprises a flexible tube having a sealed first end supporting said eyelet and a partially sealed second end to provide said passageway in said second end; said trunk of said passageway stopper means being supported at said second end, whereby a passageway stopper means of one of said plurality of bladders may be releasably engaged in an eyelet of another of said plurality of bladders thereby permitting end-to-end joining of said plurality of bladders.

7. The inflatable packaging of claim 6 wherein said passageway stopper means is made of a flexible material and has a truncated conical shape such that at least a portion of said passageway stopper means has an interference fit with said eyelet.

8. The inflatable packaging material of claim 5 wherein said plurality of bladders are constructed of vinyl or rubber.

* * * * *